US006670519B1

(12) United States Patent
Sohn et al.

(10) Patent No.: US 6,670,519 B1
(45) Date of Patent: Dec. 30, 2003

(54) MONOMETHYL PARAFFIN ADSORPTIVE SEPARATION PROCESS

(75) Inventors: Stephen W. Sohn, Arlington Heights, IL (US); Santi Kulprathipanja, Inverness, IL (US); James E. Rekoske, Glenview, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/977,862

(22) Filed: Oct. 15, 2001

(51) Int. Cl.[7] ..... C07C 7/13
(52) U.S. Cl. ..... 585/826; 585/820; 585/825
(58) Field of Search ..... 585/820, 825, 585/826

(56) References Cited

U.S. PATENT DOCUMENTS

| | | | | |
|---|---|---|---|---|
| 4,367,364 A | | 1/1983 | Kulprathipanja | 585/826 |
| 4,455,444 A | | 6/1984 | Kulprathipanja et al. | 585/826 |
| 4,956,521 A | | 9/1990 | Volles | 585/826 |
| 4,992,618 A | | 2/1991 | Kulprathipanja | 585/820 |
| 5,262,144 A | | 11/1993 | McCulloch | 423/328.2 |
| 5,276,231 A | | 1/1994 | Kocal et al. | 585/323 |
| 5,276,246 A | | 1/1994 | McCulloch et al. | 585/829 |
| 5,292,990 A | | 3/1994 | Kantner et al. | 585/820 |
| 6,222,088 B1 | * | 4/2001 | Kulprathipanja | 585/820 |

FOREIGN PATENT DOCUMENTS

| | | | |
|---|---|---|---|
| WO | 99/07656 | 2/1999 | C07C/7/00 |

OTHER PUBLICATIONS

Schulz, R.C. et al. LAB Production *Poster Session 2nd World Conference on Detergents* Montreux, Switzerland (Oct. 5–10, 1986).

Hoering, Thomas C., et al. Shape–Selective Sorption of Monomethylalkanes By Silicalite, A Zeolitic Form of Silica *Journal of Chromatography* 316 (1984) pp. 333–341 1984 Elsevier Science Publishers B.V.

* cited by examiner

*Primary Examiner*—Thuan D. Dang
(74) *Attorney, Agent, or Firm*—John G. Tolomei; James C. Paschall; David J. Piasecki

(57) ABSTRACT

The amount of the adsorbent needed to recover a set quantity of monomethyl branched $C_{10}$–$C_{15}$ paraffins from a mixture comprising normal paraffins and other nonnormal hydrocarbons such as di-isoparaffins, di-isoolefins, naphthenes and aromatics by simulated moving bed adsorptive separation is reduced by adjusting three operating factors: percentage recovery of the paraffin, operating temperature and cycle time. This reduces the capital cost of the process. The recovered monomethyl hydrocarbons may be used to form a monomethyl branched alkylaromatic hydrocarbon useful as a detergent precursor.

12 Claims, No Drawings

MONOMETHYL PARAFFIN ADSORPTIVE SEPARATION PROCESS

FIELD OF THE INVENTION

The subject invention relates to a process for the adsorptive separation of hydrocarbons. More specifically, the invention relates to a process for the continuous simulated countercurrent adsorptive separation of monomethyl paraffins from a mixture containing other hydrocarbons having the same number of carbon atoms per molecule. A preferred application of the process is the separation of $C_{10}$–$C_{15}$ monomethyl paraffins from a n-paraffin depleted kerosene boiling range fraction.

BACKGROUND OF THE INVENTION

Most of the detergents in use today are derived from precursor petrochemicals. The currently predominant precursor is linear alkyl benzene (LAB), which is commonly produced by the alkylation of benzene with a long straight (normal) chain linear olefin. The subject invention is directed to the production of monomethyl acyclic olefins and paraffins, which may be recovered as a product in their own right, or used in the production of various petrochemicals as through alkylation or oxygenation. The following description of the invention will mainly address the recovery and use of the monomethyl hydrocarbons in the production of detergent precursor petrochemicals, and in particular the production of alkylbenzene derived detergents.

Several quality characteristics of alkylbenzenesulfonate (ABS) detergents are set by the chemical structure of the alkyl side chain. For instance, linear alkyl groups have the advantage of increased biodegradability. Other characteristics of a detergent such as its effectiveness in hard or cold water and its foaming tendency are also influenced by the structure of the side chain and its constituents. It has recently been determined that highly desirable detergent precursors can be formed from olefins which contain on average approximately one methyl side chain on the main alkane chain. These have been termed "slightly" branched paraffins. Alkylbenzenes containing these monomethyl sidechains can be used by themselves or in admixture with linear alkyl benzenes to form a variety of detergent and cleaning products having superior cold and hard water properties. This is a departure from the previous preference for straight side chains. This unexpected advantage of monomethyl alkylbenzenes as detergent ingredients is described in U.S. Pat. Nos. 6,232,282 B1 and 6,228,829 B1. The subject invention is specifically directed to the production of monomethyl hydrocarbons for use in the subsequent production of the detergents and cleaning products of these two patents.

RELATED ART

The large utility of detergents and other cleaners has led to extensive development in the areas of detergent production and formulation. While detergents can be formulated from a wide variety of different compounds much of the world's supply is formulated from chemicals derived from alkyl benzenes. The compounds are produced in petrochemical complexes in which an aromatic hydrocarbon, typically benzene, is alkylated with an olefin of the desired structure and carbon number for the side chain. Typically the olefin is actually a mixture of different olefins forming a homologous series having a range of three to five carbon numbers. The olefin(s) can be derived from several alternative sources. For instance, they can be derived from the oligomerization of $C_3$ or $C_4$ olefins or from the polymerization of ethylene. Economics has led to the production of olefins by the dehydrogenation of the corresponding paraffin being the preferred route to produce the olefin.

Paraffins having 8 to 15 carbon atoms per molecule are present in significant concentrations in relatively low cost kerosene boiling range fractions of crude oils or processed fractions of crude oil. The carbon number range is set by the boiling point range of the kerosene. Recovery of the desired paraffins from kerosene by adsorption has become the leading commercial source of the olefinic precursors. The production of the olefins starts with recovery of paraffins of the same carbon number by adsorptive separation from kerosene. The paraffins are then passed through a catalytic dehydrogenation zone wherein some of the paraffins are converted to olefins. The resultant mixture of paraffins and olefins is then passed into an alkylation zone in which the olefins are reacted with the aromatic substrate. This overall flow is shown in U.S. Pat. No. 5,276,231 directed to an improvement related to the adsorptive separation of byproduct aromatic hydrocarbons from the dehydrogenation zone effluent. PCT International Publication WO 99/07656 indicates that paraffins used in this overall process may be recovered through the use of two adsorptive separation zones in series, with one zone producing normal paraffins and another producing mono-methyl paraffins.

A description of the use of simulated moving bed adsorptive separation to recover paraffins from a kerosene boiling range petroleum fraction is provided in a presentation made by R. C. Shulz et al. at the 2nd World Conference on Detergents in Montreux, Switzerland on Oct. 5–10, 1986. This shows several incidental steps in the process such as fractionation and hydrotreating.

The success of a particular adsorptive separation is determined by many factors. Predominant among these are the composition of the adsorbent (stationary phase) and desorbent (mobile phase) employed in the process. The remaining factors are basically related to process conditions, which are very important to successful commercial operation. The subject process employs an adsorbent comprising a molecular sieve referred to in the art as silicalite. The use of silicalite in the adsorptive separation of paraffins is described in U.S. Pat. No. 4,956,521 issued to W. K. Volles, which is directed to the production of higher octane gasoline blending components. The sequential use of silicalite and zeolite 5A in the separation of monomethylalkanes is described in an article in the *Joumal of Chromatography*, 316 (1984) 333–341. Silicalite has also been described as useful in separating normal paraffins from cyclic hydrocarbons and from branched chain hydrocarbons in U.S. Pat. Nos. 4,367,364 and 4,455,444 issued to S. Kulprathipanja and R. W. Neuzil. This separation differs from that performed in the subject process as it corresponds to that done in the previously cited article from the World Conference on Detergents, which is performed to recover normal paraffins.

The unique pore structure of silicalite has also led to efforts to employ it in the separation of linear (normal) olefins. However, silicalite also has catalytic properties which can result in undesired conversion of olefins during this separation. The use of silicalite based adsorbents in the separation of linear olefins from nonlinear hydrocarbons and treatments of the silicalite to reduce its catalytic activity are described in U.S. Pat. Nos. 5,262,144 to McCulloch; 5,276,246 to McCulloch et al, and 5,292,990 to Kanter et al.

Temperature has been recognized to be important operating parameter in SMB processes. Temperature ranges for traditional normal paraffin SMB processes are set out in U.S. Pat. Nos. 4,367,364 and 4,992,618. The latter also mentions a cycle time of 60 minutes.

SUMMARY OF THE INVENTION

The invention is a simulated moving bed adsorptive separation process for the recovery of monomethyl paraffins or olefins from admixture with other nonnormal paraffins or olefins, e.g., cyclic and multibranched paraffins of the same carbon number. The invention is characterized by the use of a unique set of operating conditions including low adsorption zone cycle time and temperature.

A broad embodiment of the invention may be characterized as a simulated moving bed adsorptive separation process for the separation of a $C_8$ to $C_{14}$ monomethyl paraffin from a feed mixture comprising the monomethyl paraffin and at least one other acyclic $C_8$ to $C_{14}$ non-normal hydrocarbon of the same carbon number, with the feed mixture containing less than 5 wt. % normal $C_8$ to $C_{14}$ paraffins, which process comprises passing the feed mixture into a bed of adsorbent under conditions which result in the removal of less than 95 wt. percent of the monomethyl paraffin from the feed mixture and include an A/F ratio of 0.5 to 1.5, a temperature of from about 30 to 120° C., and a cycle time of about 20 to 60 minutes, and then recovering selectively adsorbed monomethyl paraffin from the bed of adsorbent by contacting the bed of adsorbent with a desorbent compound. While the removal of the monomethyl paraffin is intentionally limited, it is a positive amount preferably greater than 50 percent and more preferably greater than 75 percent. A preferred monomethyl recovery range is from 80–95 percent. A more preferred cycle time range is from 20 to 45 minutes.

DETAILED DESCRIPTION AND PREFERRED EMBODIMENTS

In numerous processes described in the patent literature molecular sieve adsorbents are used to separate various hydrocarbons and other chemical compounds such as aromatics, paraffins, chlorinated aromatics, and chiral compounds. The separations which have been the specific focus of these processes include class separation based upon molecular shape. These include separations of linear from nonlinear aliphatic hydrocarbons and linear versus nonlinear olefinic hydrocarbons. Adsorptive separation is often used when (1) the compounds being separated have similar volatilities which prevent ready separation by fractional distillation or (2) a class separation covering a range of compounds is desired. Examples of hydrocarbon separation by class include the recovery of either normal paraffins or aromatics from a feed mixture comprising both aromatics and mixed paraffins. The separation of $C_{10}$–$C_{14}$ linear paraffins from other $C_{10}$–$C_{14}$ hydrocarbons described in the references cited above is another example of such a class separation.

The desirability of detergents based upon mono-methyl alkylbenzenes was disclosed in PCT publication WO 99/07656 and the previously cited U.S. patents. These references also describe in general terms the recovery of the desired mono-methyl paraffins from the raffinate of an adsorptive separation zone using a second adsorptive separation zone. The references describe several adsorbents including zeolites and silicoaluminophosphates of specific pore sizes and suggest the use of a lower molecular weight n-paraffin such as heptane or octane as a desorbent.

It is an objective of the invention to provide an improved process for the adsorptive separation of monomethyl hydrocarbons from other hydrocarbons. It is a specific objective to provide a simulated moving bed adsorptive separation process to simultaneously recover both normal and monomethyl paraffins from a mixed hydrocarbon feed stream.

The subject process is directed to the separation and recovery of monomethyl paraffins from a mixture containing other non-normal paraffins. In many respects it resembles the processes used to recover normal paraffins from similar feeds. The feed stream may also comprise normal paraffins or olefins of the same carbon number although the concentration of normal paraffins is preferably relatively low e.g. less than 2 or 5 wt. %. That is, it may be the raffinate stream of an upstream adsorptive separation process which selectively removes a very large percentage of the normal paraffins.

The effluent of such an adsorptive separation zone will normally be substantially free of sulfur compounds due to hydrodesulfurization, and possibly other treatment, of the feed to the upstream adsorptive separation zone. However, it has been found that the preferred adsorbent of the present process can function effectively in the presence of substantial amounts of organic sulfur compounds. This surprising result allows the subject process to process a raw or unhydrotreated feed stream. As used herein the term "unhydrotreated" means the feed has not been passed into contact with a hydrotreating catalyst in the presence of hydrogen for the purpose of reducing the sulfur content of the feed. Thus the feed may contain up to 10,000 ppm or more organic sulfur although less than 1,000 ppm is typical. A feed fraction derived from a kerosene may contain about 0.1 to about 30 wt. % n-paraffins and 5 to 25 wt. % MMP. Hydrotreating will not change the paraffin concentrations of the feed stream.

The ability to alternatively process a raw feed in the adsorption zone is advantageous. It eliminates the need to hydrotreat the feed. This can eliminate the need for a hydrotreater or, assuming the feed will be hydrotreated downstream, reduce its size. Since the subject process does not require the feed to be hydrotreated, the feed is not changed in character as by aromatic saturation. This causes less change in the composition of the kerosene upon blending the raffinate back into the remainder of a raw kerosene stream. This can be an important consideration if the removal of paraffins begins to change the physical properties of the larger kerosene stream, such as viscosity or lubricity which are important to the use of this material in a transportation fuel. The extraction of monomethyl paraffins and normal paraffins may be beneficial to the raw kerosene as by improving its cold flow properties. That is, the lower concentration of fairly straight paraffins results in a "dewaxing" of the source kerosene stream. The subject invention, therefore, includes a sequence of steps which comprise dividing the raw, source kerosene stream into two fractions, extracting monomethyl paraffins from a first kerosene fraction by adsorptive separation to yield a monomethyl paraffin stream, hydrotreating the monomethyl paraffin stream and then using it in the production of a detergent, and reblending the two kerosene fractions to yield a modified raw kerosene stream. With a silicalite adsorbent the product monomethyl paraffin stream would also contain normal paraffins. As the preferred feed to the subject adsorptive separation has been first processed in an adsorption zone for the recovery of normal paraffins, the feed to the subject separation will normally be hydrotreated because of the sulfur sensitivity of the adsorbents used in the normal paraffin adsorption zone.

This multi-step process may be characterized as a simulated moving bed process for the adsorptive separation of a monomethyl paraffin from a feed mixture comprising the monomethyl paraffin and a normal paraffin and an acyclic non-normal hydrocarbon of the same carbon number, which process comprises fractionating an unhydrotreated kerosene boiling range process stream to yield the feed mixture, which comprises hydrocarbons having between 8 and 14 carbon atoms and contains more than 50 ppm organic sulfur and a first process stream, passing the feed mixture into the bed of an adsorbent comprising silicalite under conditions which result in the removal of less than 95 percent of the monomethyl paraffin from the feed mixture and include a temperature of from about 35 to 80° C., recovering a raffinate stream comprising unadsorbed hydrocarbons and recovering an extract stream comprising recovered selectively adsorbed normal and monomethyl paraffin from the bed of adsorbent by contacting the adsorbent bed with a desorbent compound; and admixing the raffinate stream with the remaining portion of the unhydrotreated kerosene boiling range process stream to form a process stream which is withdrawn from the process.

The recovered monomethyl hydrocarbons have utility by themselves. They can be used in the production of a variety of other chemicals, including oxygenates such as alcohols and ethers, and carbohydrates such as sugars. The recovered paraffins can be subjected to conversion steps such as chlorination, nitration or alkylation to result in the production of products, such as solvents and lubricants. However, a much preferred end use of the monomethyl paraffins is in the production of detergent ingredients or precursor compounds such as alkylbenzenes. The alkylbenzenes may then be converted to a modified alkylbenzenesulfonate (MAS) as by sulfonation with sulfur trioxide or sulfuric acid followed by neutralization. The product hydrocarbons can also be used in the production of other detergent precursors or detergent ingredients including ethoxylates and alcohol sulfates or even sulfated carboxylic acids by a standard sequence of known reactions. The branched olefinic hydrocarbons of the invention may also be converted to cleaning product ingredients by alkylation with toluene or phenol followed by alkoxylation or sulfonation, or by hydroformulation followed by a secondary step such as alkoxylation, sulfation, phosphation, oxidation or a combination of these steps. The resultant ingredients are then often combined with other ingredients such as bleaches, enzymes, nonphosphate builders, activators, co-surfactants and the like. Alkylbenzene compounds are consumed in the production of a variety of anionic surfactants compounded into detergents, cleaning compounds, bar soaps and laundry or dishwashing detergents. The monomethyl hydrocarbon or the monomethylalkylbenzene can be subjected to oxidation to form $C_8$–$C_{18}$ alcohols or acids or can be sulfonated. The alcohols produced in this manner can be a finished product or a petrochemical feedstock consumed in the manufacture of a non-detergent product.

Adsorptive separations can be performed in a batch or continuous mode including the use of two or more adsorbent beds in cyclic operation. However, significant operational and economic advantages accrue to performing the separation on a continuous basis which produces a product of uniform composition. The preferred method of achieving continuous operation and uniform products is by the use of simulated moving bed technology. The following description of the invention is therefore only in terms of the separation of various monomethyl paraffins from other hydrocarbons as it would be performed in large scale simulated moving bed (SMB) units.

The performance of SMB units, as measured by such criteria as product purity and product yield, is impacted by a large number of operational variables, such as operating temperature and desorbent composition. It has now been found that by intentionally limiting the percent recovery of the desired product paraffin that the size and cost of the adsorption zone can be surprisingly reduced. While allowing the recovery of the paraffin to decrease could be expected to result in a reduction in the size of the required amount of adsorbent, it was not expected that this would interact with other operation variables, specifically cycle length and operating temperature, to provide a disproportionately sized increase in the total production while using the same quantity of adsorbent. That is, when operating at the reduced recovery rate, the decrease in the amount of adsorbent required to produce a set quantity of product is much more than was expected on the basis of decreased cycle time. It is to be noted that in this comparison the total amount of paraffin recovered in the process remains constant. The process, therefore requires an abundance of feed. The flow rate of the feed stream is increased to compensate for the decreased recovery. For example, the percent recovery may be reduced from 98 to 92 percent, which means more of the desired paraffin is allowed to remain in the raffinate stream. To compensate for this the feed rate is increased.

This surprising result can be used to reduce the required size of a new adsorption zone. Alternatively it can be used to increase the output of an existing unit.

Most SMB adsorptive separation units simulate countercurrent movement of the adsorbent and the feed stream. This simulation is performed using established commercial technology wherein the adsorbent is held fixed in place in a number of subbeds retained in one or more cylindrical adsorbent chambers. The positions at which the streams involved in the process enter and leave the chambers are periodically shifted from subbed to subbed along the length of the adsorbent chambers so that the streams enter or leave different subbeds as the operational cycle progresses. Normally there are at least four streams (feed, desorbent, extract and raffinate) employed in this procedure, and the location at which the feed and desorbent streams enter the chamber(s) and the extract and raffinate streams leave the chamber(s) are periodically shifted in the same direction at set intervals. Each periodic incremental shift in the location of these transfer points delivers or removes liquid from a different subbed of adsorbent within the chamber. The time required for the location of the feed point to completely move through all of the subbeds is the "cycle time" of the process." This shifting could be performed using a dedicated line for each stream at the entrance to each subbed. However, this would greatly increase the cost of the process and therefore the lines are reused. Only one line is normally employed for each subbed, and each bed line carries one of the four process streams at some point in the cycle. This simulation procedure normally also includes the use of a variable flow rate pump which pushes liquid leaving one end of the adsorbent vessel(s) to the other end in a single continuous loop.

Simulated moving bed processes typically include at least three or four separate steps which are performed sequentially in separate zones in one or both of the vertical cylindrical adsorption chambers. The location of the zones gradually moves through the adsorbent chamber(s). Each of these zones normally is formed from a plurality of subbeds of adsorbent, with the number of subbeds per zone ranging from 2 or 3 up to 8–10. The most widely practiced commercial process units typically contain about 24 beds. The subbeds are structurally separated from one another by horizontal liquid collection/distribution grids. Each grid is connected to a transfer line defining a transfer point at which process streams such as the feed raffinate and extract streams enter or leave the vertical adsorption chambers.

It has become customary in the art to describe the simulated moving bed (SMB) adsorptive separation process in terms of zones. Usually the process is described in terms of 4 or 5 zones. First contact between the feed stream and the adsorbent is made in Zone I, the adsorption zone. The adsorbent or stationary phase in Zone I retains a desired class of compounds and becomes surrounded by liquid which contains the undesired compounds, that is, with raffinate. This liquid is removed from the adsorbent in Zone II, referred to as a purification zone. In the purification zone the undesired raffinate components are flushed from the void volume of the adsorbent bed by a material which is easily separated from the desired component by fractional distillation. In the desorption zone or Zone III of the adsorbent chamber(s) the desired compound is released from the adsorbent by exposing and flushing the adsorbent with the desorbent (mobile phase). The released desired compounds and accompanying desorbent are removed from the adsorbent in the extract stream. Zone IV is a quantity of adsorbent located between Zones I and III which is used to segregate Zones I and III. In Zone IV desorbent is partially removed from the adsorbent by a flowing mixture of desorbent and undesired components of the feed stream. The liquid flow through Zone IV prevents contamination of Zone III by Zone I liquid by flow cocurrent to the simulated motion of the adsorbent from Zone III toward Zone I. A more thorough explanation of simulated moving bed processes is given in the Adsorption, Liquid Separation section of the *Kirk-Othmer Encyclopedia of Chemical Technology* and in the previously cited references. The terms "upstream" and "downstream" are used herein in their normal sense and are interpreted based upon the overall direction in which liquid is flowing in the adsorbent chamber. That is, if liquid is generally flowing downward through a vertical adsorbent chamber, then upstream is equivalent to an upward or higher location in the chamber.

The general technique employed in the performance of a simulated moving bed adsorptive separation process is well described in the open literature. For instance a general description of a process directed to the recovery of paraxylene by SMB was presented at page 70 of the September 1970 edition of *Chemical Engineering Progress* (Vol. 66, No 9). A generalized description of the process with an emphasis on mathematical modeling was given at the International Conference on "Fundamentals of Adsorption", Schloss Elmau, Upper Bavaria, Germany on May 6–11, 1983 by D. B. Broughton and S. A. Gembicki. Another useful reference is U.S. Pat. No. 2,985,589, incorporated herein by reference for its teaching of the practice of simulated moving bed adsorptive separation processes. Numerous other available references describe many of the mechanical parts of a simulated moving bed system, including rotary valves for distributing various liquid flows to the bed lines, the internals of the adsorbent chambers and control systems.

Cyclic advancement of the input and output streams of this simulation can be accomplished by a manifolding system or by rotary disc valves as shown in U.S. Pat. Nos. 3,040,777 and 3,422,848. Equipment utilizing these principles can vary in size from the pilot plant scale shown in U.S. Pat. No. 3,706,812 to commercial petrochemical plant scale, with flow rates ranging from a few cc per hour to many thousands of gallons per hour. Large scale plants normally employ rotary valves having a port for each transfer line while small scale and high pressure units tend to use valves having only two or three ports. The invention may also be practiced in a cocurrent process, like that disclosed in U.S. Pat. Nos. 4,402,832 and 4,478,721. The functions and properties of adsorbents and desorbents in the chromatographic separation of liquid components are well-known, and reference may be made to U.S. Pat. No. 4,642,397, which is incorporated herein, for additional description of these adsorption fundamentals.

During the adsorption step of the process a feed mixture containing a mixture of compounds is contacted with the adsorbent at adsorption conditions and one or more compound(s) or a class of compounds is selectively adsorbed and retained by the adsorbent while the other compounds of the feed mixture are relatively unabsorbed. Normally the desired compound is adsorbed. The feed mixture may contain a large variety of compounds including isomers of the desired compound. For instance, a mixed xylene feed stream may contain ethylbenzene and/or $C_9$ aromatics and can be processed to recover a specific isomer by a suitable adsorbent/desorbent pair operated at suitable conditions.

When the adsorbent contains a near equilibrium loading of the more selectively adsorbed compound, it is referred to as a "rich" adsorbent. In the next step of the process, the unabsorbed (raffinate) components of the feed mixture are removed from the void spaces between the particles of adsorbent and from the surface of the adsorbent. This depleted liquid and any desorbent which becomes admixed with it during passage through the adsorption zone in this step is removed from the process as part of a process stream referred to as the raffinate stream. The adsorbed compound is then recovered from the rich adsorbent by contacting the rich adsorbent with a stream comprising the desorbent material at desorption conditions in a desorption step. The desorbent displaces the desired compound from the adsorbent to form an extract stream, which is normally transferred to a fractionation zone for recovery of the desired compound from the extract stream containing a mixture of the desired compound and desorbent. It should be noted that in some instances the desired product of the process is present in the raffinate stream rather than the extract stream and the process adsorbs undesired compounds.

For purposes of this description, various terms used herein are defined as follows. A "feed mixture" is a mixture containing one or more extract components and one or more raffinate components to be separated by the process. The term "feed stream" indicates a stream of a feed mixture which is passed into contact with the adsorbent used in the process. An "extract component" is a compound or class of compounds that is more selectively adsorbed by the adsorbent while a "raffinate component" is a compound or class of compound that is less selectively adsorbed. The term "desorbent" means generally a material capable of and used for desorbing an extract component from the adsorbent. The term "raffinate stream" means a stream in which a raffinate component is removed from the adsorbent bed after the adsorption of extract compounds. The composition of the raffinate stream will vary over time, following a stepping of subbed liquid transfer lines, from essentially 100% desorbent material to essentially 100% raffinate components. The term "extract stream" or "extract output stream" means a stream in which an extract material, which has been desorbed by a desorbent, is removed from the adsorbent bed. The composition of the extract stream can vary from essentially 100% desorbent to essentially 100% extract components.

The extract stream and the raffinate stream are passed into separation means, typically fractional distillation columns, where at least a portion of desorbent material is recovered and an extract product and a raffinate product are produced. The extract stream may be rich in the extract component or may only contain an increased concentration. When used relative to a process stream the term "rich" is intended to indicate a concentration of the indicated compound or class of compounds greater than 50 mole percent.

The desorbent employed in the subject process can be a single component or a mixture of two or more compounds. One suitable mixture for the separation of monomethyl paraffins comprises a mixture of a normal paraffin and an isoparaffin or other branched paraffin such as a 70/30 (mol %) mixture of n-pentane and i-octane. A desorbent blend containing 40–60% branched paraffin is preferred. The desorbent can also be a single component such as n-heptane or n-hexane. The preferred normal paraffin is n-hexane, and the desorbent may range from 0 to 100% normal paraffin. Normal paraffins are strong desorbents and N-hexane is actually the strongest desorbent of these compounds. A mixture of a $C_5$ to $C_8$ normal paraffin and a methylcycloparaffin of similar carbon number, such as a 50/50 mixture of n-hexane and cyclohexane is another suitable desorbent. These mixtures may contain from about 10 to about 90 vol. % cycloparaffins. Preferred cycloparaffins are cyclopentane, cyclohexane and methylcyclohexane. In all of these cases the desorbents are hydrocarbons having a lower boiling point which allows their facile separation from the extract and raffinate components by fractional distillation. The desorbent compound(s) therefore preferably has from about 5 to 8 carbon atoms per molecule.

Specific adsorbentdesorbent pairs have been developed for different separations and the use of a specific adsorbent-desorbent combination is normally critical to acceptable commercial performance. The preferred adsorbent for use in the recovery of monomethyl paraffins comprises silicalite. Silicalite is well described in the literature. It is disclosed and claimed in U.S. Pat. No. 4,061,724 issued to Grose et al. A more detailed description is found in the article, "Silicalite, A New Hydrophobic Crystalline Silica Molecular Sieve," *Nature*, Vol. 271, Feb. 9, 1978 which is incorporated herein by reference for its description and characterization of silicalite. Silicalite typically has a silica:alumina ratio above 300:1. Silicalite is a hydrophobic crystalline silica molecular sieve having an MFI type structure of intersecting bent-orthogonal channels formed with two cross-sectional geometries, 6 Å circular and 5.1–5.7 Å elliptical on the major axis. This gives silicalite great selectivity as a size selective molecular sieve. Due to its essentially aluminum free structure composed of silicon dioxide, silicalite does not show ion-exchange behavior.

Thus silicalite is not a zeolite.

The active component of the adsorbent is normally used in the form of small agglomerates having high physical strength and attrition resistance. The agglomerates contain the active adsorptive material dispersed in an amorphous, inorganic matrix referred to as the binder and having channels and cavities therein which enable fluid access to the adsorptive material. Methods for forming the crystalline powders into such agglomerates include the addition of an inorganic binder, generally a clay comprising a silicon dioxide and aluminum oxide, to a high purity adsorbent powder in a wet mixture. The binder aids in forming or agglomerating the crystalline particles. The blended clay-adsorbent mixture may be extruded into cylindrical pellets or formed into beads which are subsequently calcined in order to convert the clay to an amorphous binder of considerable mechanical strength. The adsorbent may also be bound into irregular shaped particles formed by spray drying or crushing of larger masses followed by size screening. The adsorbent particles may thus be in the form of extrudates, tablets, macrospheres or granules having a desired particle range, preferably from about 16 to about 60 mesh (Standard U.S. Mesh) (1.2 mm to 250 microns). Clays of the kaolin type, water permeable organic polymers or silica are generally used as binders.

Those skilled in the art will appreciate that the performance of a particular adsorbent is often greatly influenced by a number of factors not related to its composition such as operating conditions, feed stream composition and the water content of the adsorbent. The optimum adsorbent composition and operating conditions for the process are therefore dependent upon a number of interrelated variables. One such variable is the water content of the adsorbent which is expressed herein in terms of the recognized Loss on Ignition (LOI) test. In the LOI test the volatile matter content of the zeolitic adsorbent is determined by the weight difference obtained before and after drying a sample of the adsorbent at 500° C. under an inert gas purge such as nitrogen for a period of time sufficient to achieve a constant weight. For the subject process it is preferred that the water content of the adsorbent results in an LOI at 900° C. of less than 7.0% and preferably within the range of from 0 to 4.0 wt. %.

The silicalite will ordinarily be present in the adsorbent particles in amounts ranging from about 75 to about 98 wt. % of the particle based on volatile-free composition. Volatile-free compositions are generally determined after the adsorbent has been calcined at 900° C. in order to drive off all volatile matter. The remainder of the adsorbent will generally be the inorganic matrix of the binder present in intimate mixture with the small particles of the active adsorbent material. This matrix material may be an adjunct of the manufacturing process for the active adsorbent material, for example, from the intentionally incomplete purification of the silicalite during its manufacture.

In the practice of the present invention, a feed mixture comprising one or more monomethyl branched hydrocarbons and at least one nonnormal hydrocarbon of like carbon number but different structure is passed through one or more beds of an adsorbent which selectively adsorbs the monomethyl ranched hydrocarbon while permitting other components of the feed stream to pass through the adsorption zone in an unchanged condition. The feed may contain only paraffinic hydrocarbons or may be a mixture of paraffins and aromatic hydrocarbons. Thus, the feed mixtures to the process of this invention can contain sizable quantities of aromatic hydrocarbons and may also contain quantities of paraffins having multiple branches, paraffins having multiple carbon atoms in the branches, cycloparaffins, branched cycloparaffins or other compounds having boiling points relatively close to the desired compound isomer. At some point in time based upon the remaining capacity of the adsorbent, the flow of the feed through the adsorbent is stopped, and the adsorbent is then flushed to remove non-adsorbed materials surrounding the adsorbent. Thereafter the desired isomer is desorbed from the adsorbent by passing a desorbent stream through the adsorbent bed. A nonadsorbable component of the desorbent material (isooctane) is preferably also used to flush nonadsorbed materials from the void spaces around and within the adsorbent.

An important characteristic of an adsorbent is the rate of exchange of the desorbent for the extract component of the feed mixture or, in other words, the relative rate of desorption of the extract component. This characteristic relates directly to the amount of desorbent material that must be employed in the process to recover the extract component from the adsorbent. Faster rates of exchange reduce the amount of desorbent material needed to remove the extract component, and therefore, permit a reduction in the operating cost of the process. With faster rates of exchange, less desorbent material has to be pumped through the process and separated from the extract stream for reuse in the process. Exchange rates are often temperature dependent. Ideally, desorbent materials should have a selectivity equal to about 1 or slightly less than 1 with respect to all extract components so that all of the extract components can be desorbed as a class with reasonable flow rates of desorbent material, and so that extract components can later displace desorbent material in a subsequent adsorption step.

In adsorptive separation processes, which are preferably operated continuously at substantially constant temperature and a pressure which insures liquid phase, the desorbent material must be judiciously selected to satisfy many criteria. First, the desorbent material should displace an extract component from the adsorbent with reasonable mass flow rates without itself being so strongly adsorbed as to unduly prevent an extract component from displacing the desorbent material in a following adsorption cycle. Expressed in terms of the selectivity, it is preferred that the adsorbent be more selective for all of the extract components with respect to a raffinate component than it is for the desorbent material with respect to a raffinate component. Secondly, desorbent materials must be compatible with the particular adsorbent and the particular feed mixture. More specifically, they must not reduce or destroy the capacity of the adsorbent or selectivity of the adsorbent for an extract component with respect to a raffinate component. Additionally, desorbent materials should not chemically react with or cause a chemical reaction of either an extract component or a raffinate component. Both the extract stream and the raffinate stream are typically removed from the adsorbent void volume in admixture with desorbent material and any chemical reaction involving a desorbent material and an extract component or a raffinate component or both would complicate or prevent product recovery. The desorbent should also be easily separated from the extract and raffinate components, as by fractionation. Finally, desorbent materials should be readily available and reasonable in cost.

Feed mixtures which can be utilized in the process of this invention will typically be derived from kerosene and prepared by prior separation step(s). Feed preparation methods, such as fractional distillation, are inherently imprecise and produce a stream containing a mixture of compounds. It is expected that separation of the desired paraffins from kerosene rather than oligomerization or other forms of synthesis will provide the lowest cost adequate feed and will therefore be the predominate feed source. The carbon number range of the monomethyl paraffins desired for the production of LAB can range from 8 to 16, with a four carbon number range being preferred. A range of 10 to 14 is often preferred with a range of 11–13 being highly preferred for the subject process due to improved detergent properties. This carbon number range corresponds to linear paraffins boiling in the kerosene boiling point range, and kerosene fractions produced in petroleum refineries either by crude oil fractionation or by conversion processes therefore form suitable feed stream precursors. Fractions recovered from crude oil by fractionation will require hydrotreating for removal of sulfur and/or nitrogen prior to being fed to the subject process, if the adsorbent is sensitive to sulfur. The boiling point range of the kerosene fraction is adjusted by prefractionation to obtain the desired carbon number range of the paraffins. In an extreme case the boiling point range can be limited such that only paraffins of a single carbon number predominate. Kerosene fractions contain a very large number of different hydrocarbons and the feed to the subject process can therefore contain 200 or more different compounds.

The concentrations of normal and monomethyl paraffins in the feed will influence the composition of the recovered extract product. An alkylbenzene containing a mixture of normal and monomethyl side chains is preferred. A normal paraffin content of 20–50% in the extract is therefore desired. A feed stream ultimately resulting in alkylbenzenes of this nature can be available as the raffinate stream of an adsorptive separation process which selectively recovers the normal paraffins. The raffinate stream from such a unit will be free of contaminants such as sulfur or nitrogen containing compounds, and will also have a low concentration of normal paraffins.

The use of such a raffinate stream as the feed to the subject separation process allows integration of the subject process into an existing LAB facility, with the two adsorptive separation operations being performed in series as shown in the previously cited publication WO 99/07656. Separately recovered normal paraffins and monomethyl paraffins can then be processed in a variety of ways. For instance each paraffin stream could be processed independently via dehydrogenation and aromatic alkylation to produce two separate alkylbenzene products which are then blended as desired. Alternatively, the separate paraffin products of the two separation operations could be blended or olefins derived from each paraffin could be admixed prior to alkylation. Therefore, the feed to the downstream dehydrogenation or alkylation zone can comprise the product of the subject separation plus from about 10 to about 35 vol. percent normal hydrocarbons recovered in a different separation step or supplied externally.

The practice of the subject invention requires no significant variation in operating conditions, adsorbent or desorbent composition within the adsorbent chamber(s) or during different process steps. That is, the adsorbent preferably remains at the same temperature and pressure throughout the process. It is preferred that the entire adsorbent chamber is maintained at essentially the same operating pressure, with pressure varying only due to hydrostatic head and process flows. It is preferred that all of the process streams enter the adsorbent bed at the same temperature.

Adsorption conditions in general include a temperature range of from about 25 to about 120° C., with from about 35 to about 85° C. being preferred. Temperatures from 30° C. to 65° C. are highly preferred. The advantages derived from relatively low operating temperature is a departure from expectations. A decrease in temperature is normally expected to result in an increase in purity but a decrease in recovery. Adsorption conditions also preferably include a pressure sufficient to maintain the process fluids in liquid phase; which may be from about atmospheric to 600 psig. Desorption conditions generally include the same temperatures and pressure as used for adsorption conditions. Slightly different conditions may be preferred depending on the composition of the adsorbent and the feed.

The subject process operates at a feed rate which is characterized by the volumetric ratio of the simulated flow rate of selective adsorbent pore volume (A) to flow rate of adsorbable feed components (F). The ratio of A/F should be between about 0.5 and about 1.5.

A very important variable is the "cycle time" of the SMB unit. The cycle time is the time needed for the inlet position of feed line to make one complete pass through all sub-beds and then return to the same inlet. A shorter cycle time is equivalent to an increase in the rate of simulated adsorbent movement. Adjusting the cycle time allows adjustment of the amount of adsorbent which contacts the feed during the presence of the feed in the adsorbent chambers. A preferred range of cycle times is from about 20 to about 45 minutes.

Another important operating variable, and one which until now has not been explored, is the percentage recovery of the desired paraffin. It has been normally assumed that for a given quantity of adsorbent it is desired to maximize the recovery of the desired paraffin to maximize production. However, it has now been found that, within limits, operating at a reduced recovery rate of less than 95 vol. % and preferably less than 90 vol. % results in an increased overall production rate. It is necessary to process more feed, but the product rate from an existing unit can be increased or a new unit can be smaller than when recovery is set at an industry standard 95 or 98 vol. %. As the feed to the subject process is typically derived from a kerosene, there is normally an ample supply of feed and increasing the feed rate is not a significant problem.

The surprising benefits of the subject process can be seen from the measured performance of a small scale SMB pilot plant being used to produce a monomethyl paraffin product stream. The feed to the pilot plant was a derived from a crude oil kerosene fraction which had been hydrotreated and then distilled to contain basically only $C_{10}$ to $C_{15}$ hydrocarbons. The feed was depleted in normal paraffins due to prior adsorptive separation to recover normal paraffins. The feed contained about 2.5 wt. % normal and about 16.2 wt. % monomethyl paraffins. This feed was passed into the adsorption zone of the SMB pilot plant while it was maintained at the several listed temperatures. The adsorbent comprised silicalite bound with an inert silica binder.

In the first of a series of experiments the temperature of the adsorption zone was set at the 120° C. This temperature is representative of the operation of similar normal paraffin separation processes. The adsorbent was silica-bound silicalite. The cycle time of the pilot plant was set to 45 minutes. Flow rates were set to obtain an A/F of 1.20. The desorbent was a mixture of about 58% n-pentane and 42% isooctane. The temperature of the adsorption zone was then reduced and the experiment was repeated. At each temperature the purity of recovered extract material (normal plus monomethyl paraffins) was determined. This information is summarized below in Table 1. It indicates purity is improved by operation at lower temperatures.

| Run # | Temp ° C. | % Purity (Extract) |
|---|---|---|
| 1 | 120 | 85.4 |
| 2 | 100 | 87.8 |
| 3 | 80 | 91.6 |
| 4 | 65 | 93.2 |

Building on the results of these tests, a second series of tests was performed with the temperature held constant at 65° C. The cycle time was varied. The feed, adsorbent, etc. remained the same. Operations, however, were adjusted to obtain 92% purity similar to Run 3 above during each test run. The results of these tests are given below in Table 2. They illustrate that as the cycle time was decreased the purity of the recovered extract product comprising normal and MMP paraffins was not decreased.

| Run | Cycle Time | % Recovery |
|---|---|---|
| 5 | 45 | 68 |
| 5 | 37 | 68 |
| 7 | 36 | 70 |
| 8 | 20 | 70 |

The data indicates that reducing the cycle time of the SMB pilot plant surprisingly did not reduce the recovery of the combined extract products. It is postulated that the effect occurs because the feed is given a shorter time to equilibrate with the adsorbent. Conventional logic based on the "use" of less adsorbent would predict a reduction in total recovery with such a drastic reduction in cycle time.

As the feed to an adsorptive separation process is normally costly the normal approach to process development has been to develop ways to increase recovery. Some large scale commercial SMB units therefore operate with recoveries of 98 or even 99 wt. percent. In the following series of runs the recovery and purity were performance targets. The flow rate of the feed was adjusted to maintain an A/F of 0.92. Temperature was held constant at 60° C. and cycle time was varied. The results are given below in Table 3. The results show total purity (normal paraffins plus mono methyl paraffins) surprisingly increased as cycle time was reduced and production was increased.

The data also illustrates that by decreasing the recovery percentage it is possible to process enough feed that the amount recovered increases. This allows an increase in the production rate of an existing SMB unit or a decrease in required size of a new unit.

TABLE 3

| Run # | Cycle Time | MMP & NP Purity | MMP & NP Production |
|---|---|---|---|
| 9 | 37 | 92.5 | 100 (Base) |
| 10 | 35 | 92.7 | 105 |
| 11 | 32 | 93.0 | 113 |

What is claimed:

1. A simulated moving bed adsorptive separation process for the separation of a $C_8$ to $C_{14}$ monomethyl paraffin from a feed mixture comprising the monomethyl paraffin and at least one other acyclic $C_8$ to $C_{14}$ non-normal hydrocarbon of the same carbon number, with the feed mixture containing less than 5 wt. % normal $C_8$ to $C_{14}$ paraffins, which process comprises passing the feed mixture into a bed of adsorbent under operating conditions which include an A/F ratio of 0.5 to 1.5, a temperature of from about 30 to 120° C., and a cycle time of about 20 to 60 minutes, and then recovering selectively adsorbed monomethyl paraffin from the bed of adsorbent by contacting the bed of adsorbent with a desorbent compound wherein a positive amount less than 95 percent of the monomethyl paraffin is removed from the feed mixture.

2. The process of claim 1 wherein the conditions include a temperature of from 30 to 65° C.

3. The process of claim 1 wherein the conditions include a temperature of from 35 to 80° C.

4. The process of claim 1 wherein the cycle time is between about 20 and about 45 minutes.

5. A simulated moving bed process for the adsorptive separation of a $C_8$ to $C_{14}$ monomethyl paraffin from a feed mixture comprising the monomethyl paraffin, a normal paraffin and an acyclic non-normal hydrocarbon of the same carbon number, which process comprises passing the feed mixture into a bed of an adsorbent comprising silicalite under conditions which result in the removal of a positive amount less than 90 percent of the monomethyl paraffin from the feed mixture and which include an A/F ratio of 0.5 to 1.5, a temperature of from about 35 to 80° C., and a cycle time of about 20 to 45 minutes, and then recovering the selectively adsorbed monomethyl paraffin from the bed of adsorbent by contacting the bead of adsorbent with a desorbent compound.

6. The process of claim 5 wherein the feed mixture is at least a portion of the raffinate stream of an adsorptive separation process which recovers normal paraffins.

7. The process of claim 5 wherein the conditions result in the removal of a positive amount less than 80 percent of the monomethyl paraffin from the feed mixture.

8. A simulated moving bed process for the adsorptive separation of a monomethyl paraffin from a feed mixture comprising the monomethyl paraffin and a normal paraffin and an acyclic non-normal hydrocarbon of the same carbon number, which process comprises fractionating an unhydrotreated kerosene boiling range process stream to yield a first process stream and the feed mixture, the feed mixture comprising more than 50 ppm organic sulfur and hydrocarbons having between 8 and 14 carbon atoms, passing the feed mixture into a bed of an adsorbent comprising silicalite under conditions which result in the removal of a positive amount less than 95 percent of the monomethyl paraffin from the feed mixture and include a temperature of from about 35 to 80° C., recovering a raffinate stream comprising unadsorbed hydrocarbons and recovering an extract stream comprising recovered selectively adsorbed normal and monomethyl paraffin from the bed of adsorbent by contacting the adsorbent bed with a desorbent compound; and admixing the raffinate stream with the first process stream to form a second process stream which is withdrawn from the process.

9. The process of claim 8 wherein the desorbent comprises a $C_5$ or $C_6$ normal paraffin.

10. The process of claim 8 wherein the feed mixture also comprises a branched paraffin.

11. The process of claim 8 wherein the desorbent also comprises methylcyclohexane.

12. The process of claim 8 wherein the desorbent also comprises a normal paraffin and a cyclohexane.

* * * * *